US005305063A

United States Patent [19]

Marumoto

[11] Patent Number: 5,305,063

[45] Date of Patent: Apr. 19, 1994

[54] TONER SUPPLY DEVICE MOUNTED WITH A REPLACEABLE TONER CARTRIDGE

[75] Inventor: Takeshi Marumoto, Nara, Japan

[73] Assignee: Mita Industrial Co., Ltd., Osaka, Japan

[21] Appl. No.: 966,810

[22] Filed: Oct. 26, 1992

[30] Foreign Application Priority Data

Nov. 5, 1991 [JP] Japan ..... 3-288483

[51] Int. Cl.[5] ..... G03G 21/00; G03G 15/06

[52] U.S. Cl. ..... 355/260

[58] Field of Search ..... 355/200, 210, 260; 222/DIG. 1

[56] References Cited

U.S. PATENT DOCUMENTS 4,173,405 11/1979 Swapceinski et al. ..... 355/260 X 4,937,627 6/1990 Ozawa et al. ..... 355/260

4,965,639 10/1990 Manno et al. ..... 355/260

*Primary Examiner*—Fred L. Braun

*Attorney, Agent, or Firm*—Jordan and Hamburg

[57] ABSTRACT

A toner supply device attachable to a developing device is provided with a toner cartridge mount portion on which a toner cartridge is mounted, a toner outlet in communication with the developing device, a conveyance path which connects the toner cartridge mount portion with the toner outlet, a conveying device for conveying a specified amount of toner in the toner cartridge from the toner cartridge mount portion to a position in the vicinity of the toner outlet, and discharging the toner through the toner outlet immediately when the toner is needed in the developing device. Accordingly, the toner can be supplied to the developing device immediately after the toner density in the developing device decreases below a proper level.

4 Claims, 9 Drawing Sheets

TONER SUPPLY DEVICE MOUNTED WITH A REPLACEABLE TONER CARTRIDGE

BACKGROUND OF THE INVENTION AND RELATED ART STATEMENT

This invention relates to a toner supply device provided with a conveyance path extending from a mount position of a toner cartridge to an outlet in communication with a developing device, and adapted for supplying toner from the toner cartridge to the developing device through the conveyance path.

There have been available image forming apparatuses such as copying machines and printers in which an electrostatic latent image formed on a photosensitive member is developed with two-component developer including toner and carriers. In these image forming apparatuses, a space is defined between a frame of a main body and a cover so as to provide an operation lever or the like for maintenance. In some image forming apparatuses, a toner cartridge is provided in this space so as to make the size of the apparatus smaller.

In these image forming apparatuses, there are provided a toner conveyance path extending from the toner cartridge to a developing device, and a conveying member in the form of a spiral. The conveying member is disposed in the toner conveyance path and is drivingly rotated by a drive motor. The toner from the toner cartridge is designed to fall onto the toner conveyance path spontaneously, and the fallen toner is conveyed by the conveying member up to a toner outlet provided at a downstream side of the conveyance path. The toner is discharged to the developing device through the toner outlet.

After the existing image forming apparatus is installed at a specified place, the developing device is filled with developer having a suitable toner density. Further, a toner cartridge for supplying toner to the developing device when the toner density of the developer decreases below a given level is mounted at a toner cartridge mount portion. At this time, the toner falls onto the toner conveyance path spontaneously and is accumulated at a portion of the conveyance path right below the mount portion.

Thereafter, the toner density decreases as the toner in the developing device is consumed after the start of an image forming operation. The toner density is detected by a toner sensor, and the drive motor is driven in accordance with a sensor signal output from the toner sensor. Thereby, the toner accumulated on the conveyance path right below the cartridge mount portion is conveyed to the toner outlet by the conveying member.

However, the toner density in the developing device remains in the low level until the toner reaches the toner outlet and is supplied to the developing device. Thus, the image forming operation is obliged to continue in a state where the toner density is low until the toner density increases up to an appropriate level, and accordingly images cannot be formed properly.

Further, if the image forming operation is conducted continuously while the toner is conveyed to the toner outlet, the toner density in the developing device decreases further. When the toner density decreases as low as a toner empty level, a toner empty indication is displayed despite the fact that there still remains toner in the toner cartridge.

SUMMARY OF THE INVENTION

It is an object of the invention to overcome the problems residing in the prior art and to provide a toner supply device capable of supplying toner to a developing device immediately when the toner density in the developing device decreases below a specified level.

Accordingly, the invention is directed to a toner supply device attachable to a developing device, the toner supply device comprising mount means on which a toner cartridge is mounted; outlet means in communication with the developing device; conveyance path means for connecting the mount means with the outlet means; conveyance means for conveying a specified amount of toner in the toner cartridge from the mount means to an initial position in the vicinity of the outlet means, and discharging the toner through the outlet means immediately when the toner is needed in the developing device.

The conveyance means may include a conveying member provided in the conveyance path means, a drive motor for driving the conveying member, and control means for controlling the driving of the drive motor.

The control means may advantageously include memory means for storing a conveyance time which is calculated based on a distance between the mount means and the initial position, and a toner conveying speed of the conveying member.

It may be preferable to configure the conveying member in the form of a spiral.

The outlet means may advantageously include an oblong opening of a specified length which is defined longitudinally in the conveyance path means at a downstream side thereof.

The oblong opening may be formed such that the width thereof increases gradually as it extends more toward a downstream side with respect to a toner conveying direction.

With the toner supply device thus constructed, the toner is conveyed from the mount means to the initial position in the vicinity of the outlet means. Accordingly, the toner can be supplied to the developing device immediately even if the toner filled up in the developing device at the time of installation is consumed and thereby the toner density therein decreases. This prevents an excessive decrease in the toner density in the developing device and contributes to formation of satisfactory images. There can be also prevented the undesirable likelihood that a toner empty indication is displayed due to the excessive decrease in the toner density although there still remains toner in the toner cartridge.

These and other objects, features and advantages of the present invention will become more apparent upon a reading of the following detailed description and accompanying drawings.

DETAILED DESCRIPTION OF PREFERRED EMBODIMENTS OF THE INVENTION

Figure 1:
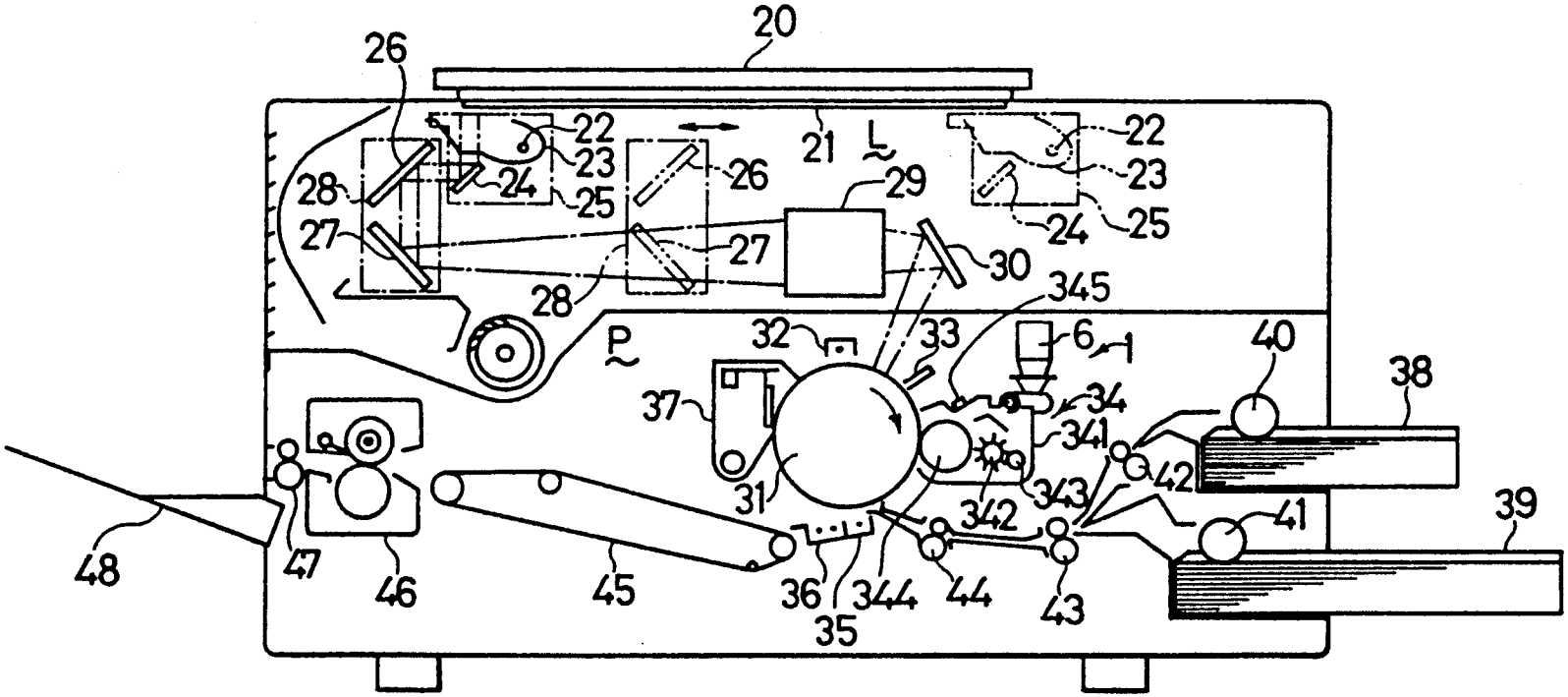
FIG. 1 is a schematic construction diagram showing an exemplary image forming apparatus incorporating a toner supply device according to the invention.

FIG. 1 is a schematic construction diagram showing an exemplary image forming apparatus (copying machine).

The copying machine is provided with a document holder 20 and a transparent document platen 21 at the top thereof, and is internally provided with an optical system L and an imaging assembly P. The document holder 20 is adapted for holding a document placed on the document platen 21.

The optical system L is provided with a first movable unit 25, a second movable unit 28, a lens array 29, and a mirror 30. The first movable unit 25 includes a lamp 22 such as a halogen lamp which serves as a light source, a reflector 23, and a mirror 24. The second movable unit 28 includes mirrors 26, 27. Upon start of a copying operation, the first movable unit 25 starts moving to scan a document image, and the light is projected from the lamp 22 onto the document placed on the document platen 21. The light reflected by the document is introduced to the lens array 29 through the mirrors 24, 26, and 27, and is projected onto a photosensitive drum 31 by way of the mirror 30. Thereby, the drum 31 is exposed.

The imaging assembly P includes the photosensitive drum 31, a main charger 32, a blank lamp 33, a developing device 34, a transfer charger 35, a separating charger 36, a cleaning device 37, etc. After being charged uniformly by the main charger 32, and having electric charges on an unnecessary region removed by the blank lamp 33, the surface of the photosensitive drum 31 is exposed to the light reflected by the document, thereby forming an electrostatic latent image thereon. Thus formed latent image is developed into a toner image by the developing device 34, which is in turn transferred to a copy sheet by the transfer charger 35. Then, the copy sheet bearing the toner image is separated from the surface of the photosensitive drum 31 by the separating charger 36. On the other hand, the toner residual on the surface of the photosensitive drum 31 is removed therefrom by the cleaning device 37. The developing device 34 is allowed to maintain the toner density therein at an appropriate level by being furnished with additional toner supplied through a toner supply device 1.

Further, there are arranged cassettes 38, 39, feed rollers 40, 41, pairs of transport rollers 42, 43, and a pair of registration rollers 44 in this order from an upstream side of a sheet feeding direction. A copy sheet contained in the cassette 38 or 39 is dispensed by the feed rollers 40 or 41 and is transported to the registration rollers 44 by the pair of transport rollers 42 or 43. The copy sheet is caused to stay at the registration rollers 44 so as to be fed to the photosensitive drum 31 as timed with the scanning of the optical system L.

Downstream of the photosensitive drum 31 are arranged a transport belt 45, a fixing device 46, a pair of discharge rollers 47, etc. in this order with respect to the sheet feeding direction. The copy sheet bearing a document image thereon which has been separated from the drum 31 is transported to the fixing device 46 by the transport belt 45. After having the image fixed thereto, the copy sheet is discharged onto a discharge tray 48 by the discharge rollers 47.

Figure 2:
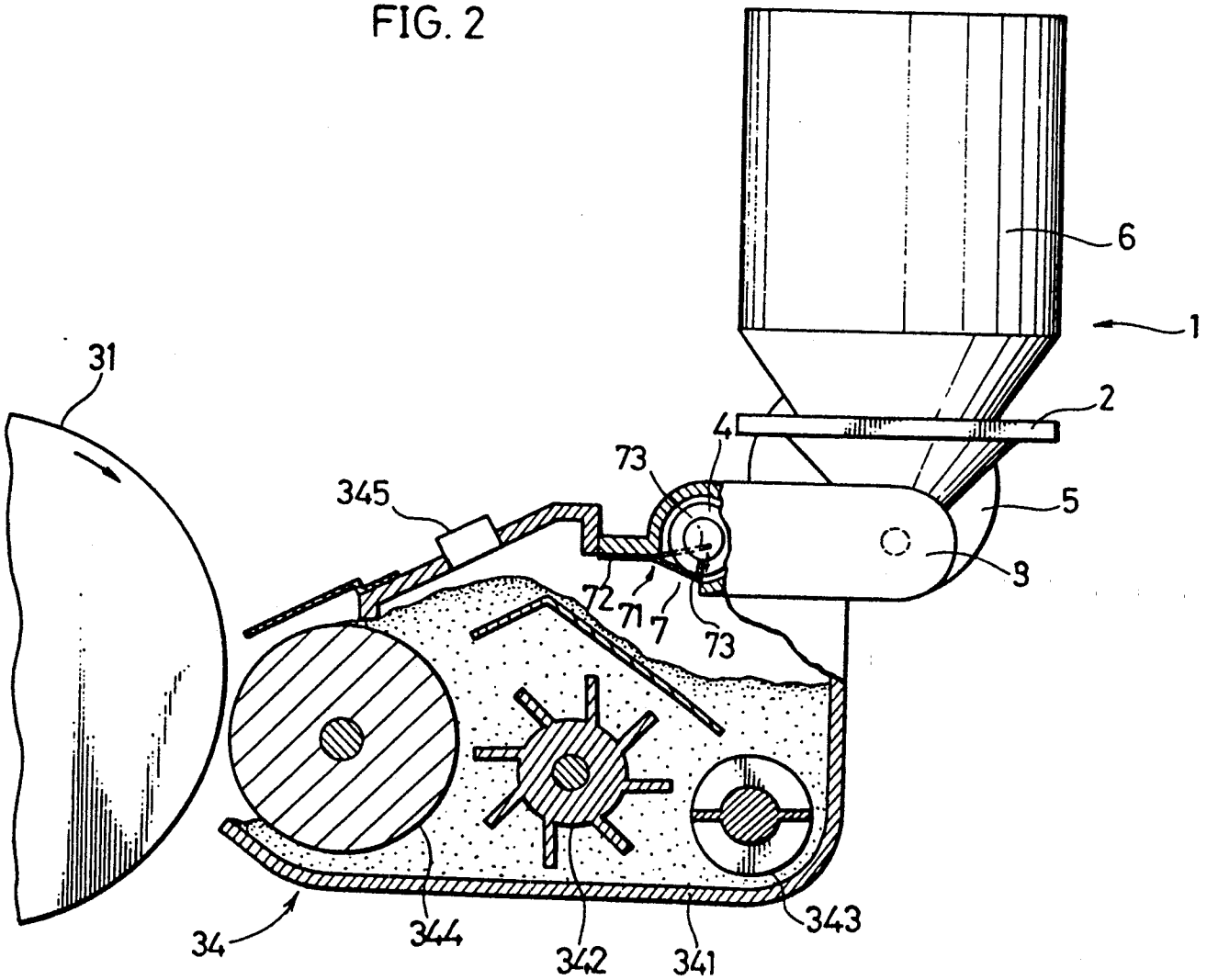
FIG. 2 is a diagram partially in section showing exemplary constructions of the toner supply device and a developing device.
Figure 3:
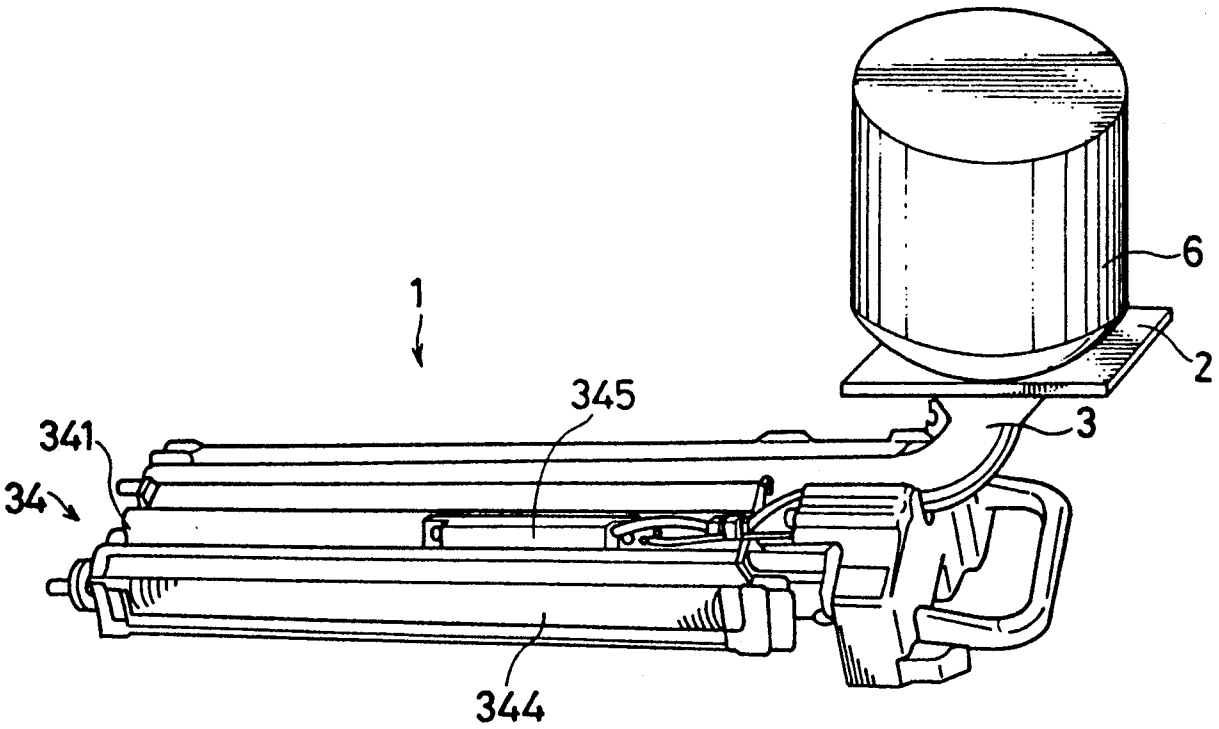
FIG. 3 is a perspective view showing the toner supply device and the developing device.
Figure 4:
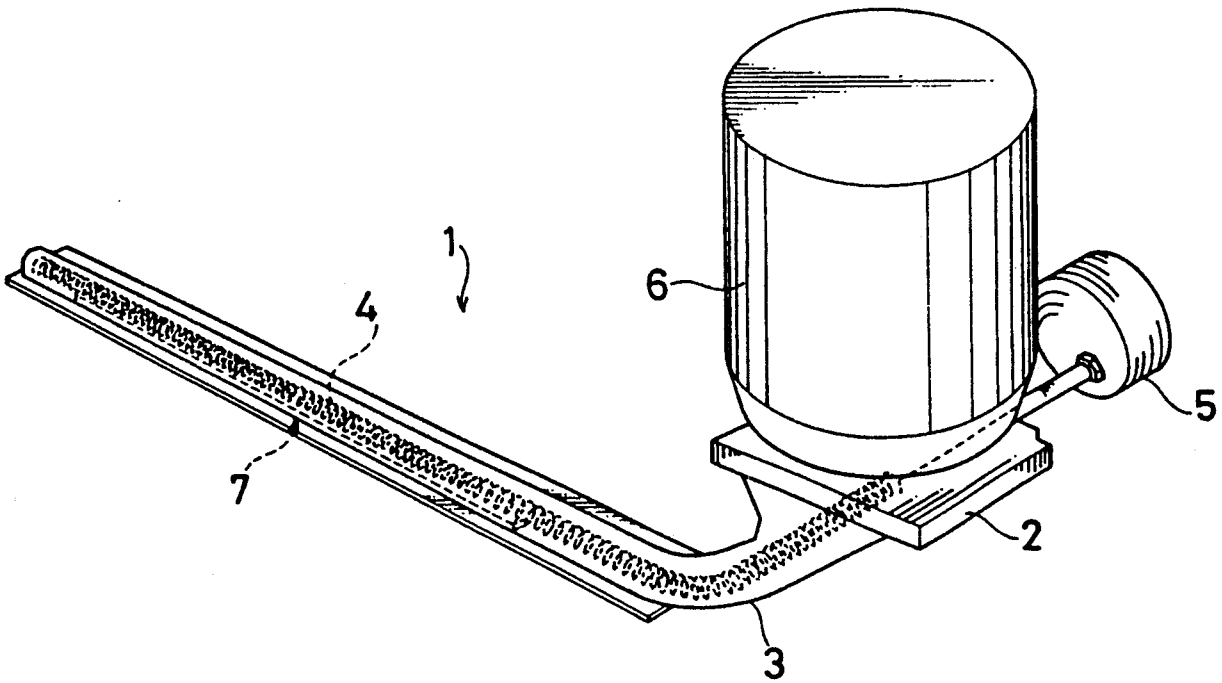
FIG. 4 is a perspective view showing the toner supply device.

There will be described constructions of exemplary developing device 34 and toner supply device 1 next with reference to FIGS. 2 to 4.

The developing device 34 includes a housing 341, agitating rollers 342, 343, a developing roller 344, and a toner sensor 345. The agitating rollers 342, 343 stir and mix two-component developer including the toner and carriers, and also cause the toner to be charged by means of frictional electrification. The developing roller 344 supplies the toner to the photosensitive drum 31, thereby developing the electrostatic latent image formed on the drum 31 into a toner image. The toner sensor 345 is provided at a top portion of the developing device 34 and located at a center with respect to a widthwise direction of the developing device 34. The sensor 345 is adapted for detecting the toner density in the housing 341.

The toner supply device 1 includes a toner cartridge mount portion 2, a toner conveyance path 3, a conveying member 4, and a drive motor 5. The mount portion 2 is provided at an upstream end of the toner conveyance path 3 with respect to a toner conveying direction, and a toner cartridge 6 is mounted on this mount portion 2. The toner cartridge 6 contains toner therein, and is mounted vertically relative to the mount portion 2 so that the toner falls onto the toner conveyance path 3 spontaneously. The toner conveyance path 3 extends in the widthwise direction of the developing device 34 from the mount portion 2, and has the conveying member 4 disposed therein. At a downstream portion of a surface of the path 3 facing the developing device 34 is defined a toner outlet 7 (see FIG. 9) of a specified length extending in the toner conveyance direction. The toner outlet 7 is formed such that the width thereof increases gradually as it extends more toward the downstream side with respect to the toner conveyance direction. The toner in the toner cartridge 6 falls onto the toner conveyance path 3 due to the weight thereof.

The conveying member 4 is configured into a spiral form, and is designed to convey the toner in the toner conveyance path 3 at a specified speed by being driven by the drive motor 5. The drive motor 5 drives the conveying member 4 in accordance with a control signal from a control unit 10 to be described later. When the conveying member 4 is driven by the drive motor 5, the toner fallen onto the toner conveyance path 3 from the toner cartridge 6 due to the weight thereof is conveyed along the path 3, and falls into the housing 341 through the toner outlet 7. In this way, the toner in the toner cartridge 6 is supplied to the developing device 34.

Figure 5:
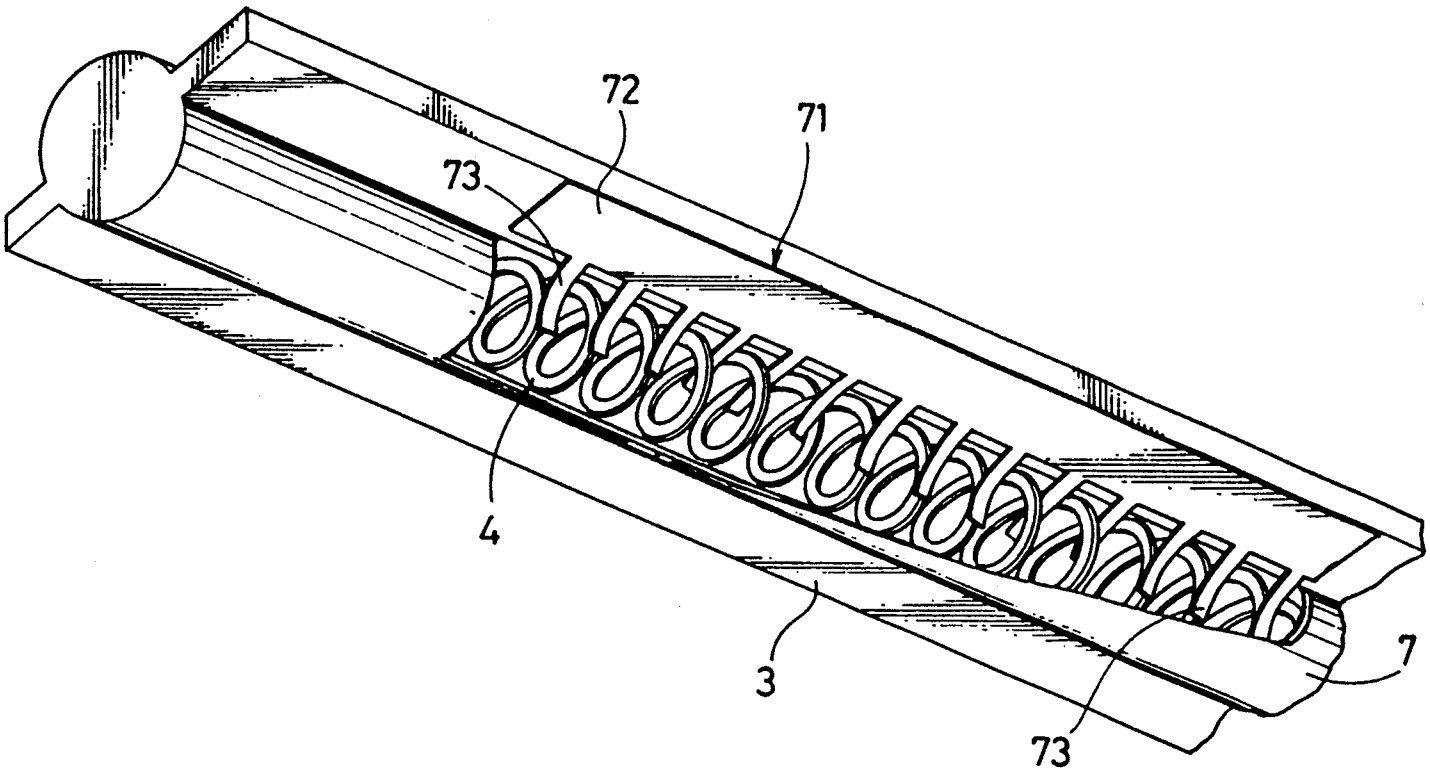
FIG. 5 is a perspective view showing an exemplary toner outlet and a raking member according to the invention.

At an upper end of the toner outlet 7 is fixed a raking member 71. The raking member 71 is formed of thin flexible material such as PET (polyethylene terephthalate) film, and includes a base portion 72 and a plurality of elastic pieces 73 extending from the base portion 72. The base portion 72 extends over the entire length of the toner outlet 7 as shown in FIG. 5. The elastic pieces 73 extend vertically from the base portion 72 in an axial direction of the conveying member 4, and are arranged at a specified spacing, for example, equal to the pitch of the spiral of the conveying member 4. The elastic pieces 73 are designed to come into contact with faces of the conveying member 4.

Figure 6:
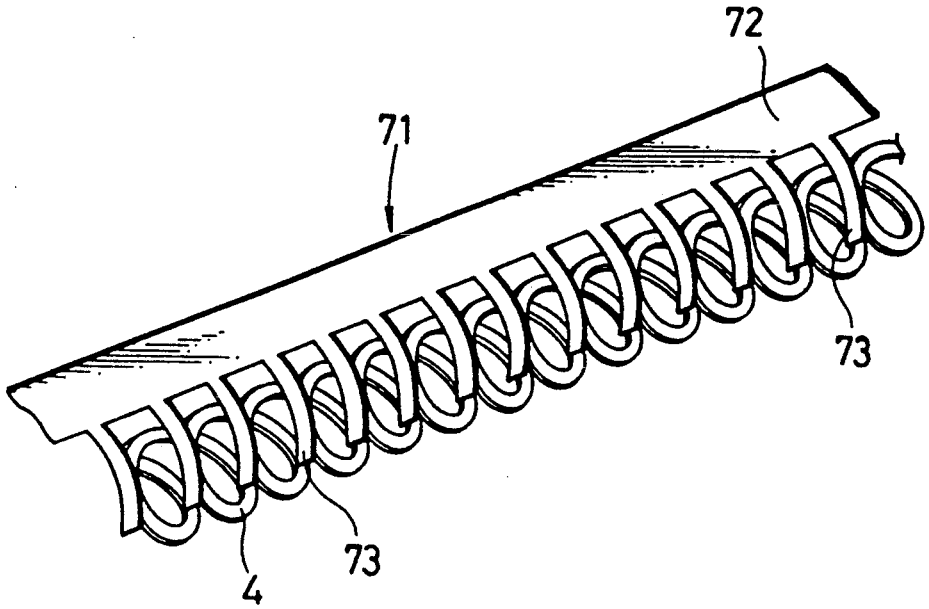
FIG. 6 is a perspective view showing a contact state where a conveying member is in contact with the raking member.
Figure 7:
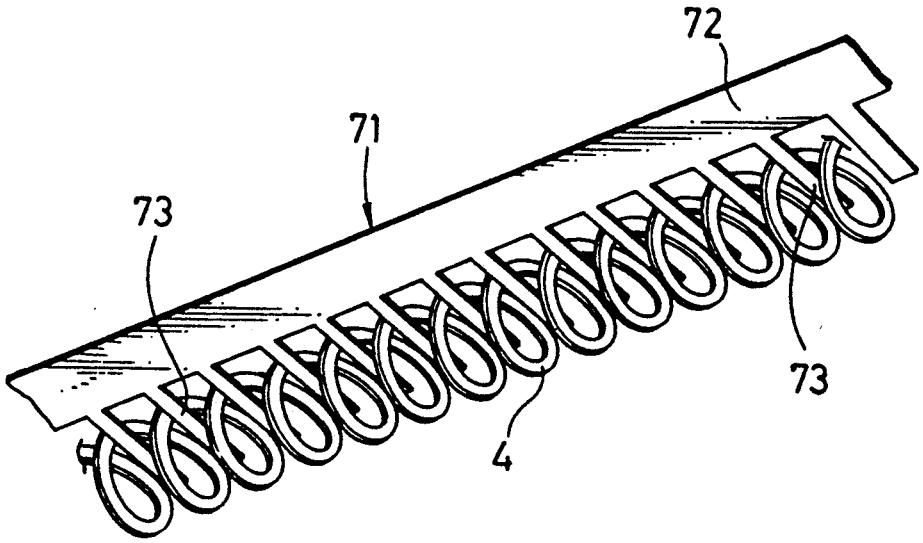
FIG. 7 is a perspective view showing another contact state where the conveying member is in contact with the raking member.

The elastic pieces 73 are brought into contact with the faces of the conveying member 4 while being elastically deformed as shown in FIGS. 6 and 7, thereby raking the toner depositing on the faces of the conveying member 4.

Since the toner depositing on the faces of the conveying member 4 is raked by the raking member 71 in this way, conveyance of the toner is not hindered by the toner depositing on the faces of the conveying member 4. Thus, the toner can be uniformly conveyed over the entire width of the developing device 34.

With the above toner outlet 7, an amount of toner supplied is smaller at an upstream side of the outlet 7 than at a downstream side thereof with respect to the toner conveying direction. This causes a variation in the toner density with respect to the widthwise direction of the developing device 34. However, since the toner is allowed to fall into the housing 341 earlier by providing the raking member 71 at the toner outlet 7, the toner can be supplied more uniformly in its amount with respect to the widthwise direction of the developing device 34. The raking member 71 also serves to reduce the likelihood that the toner falls into the developing device 34 through the toner outlet 7 inadvertently due to an impact produced when the developing device 34 is attached or detached or other cause.

It will be appreciated that the raking member 71 is not limited to the aforementioned thin raking member, but may be a brush-like raking member, for example. Even in this case, effects similar to the above are obtainable. Further, in the above description, the elastic pieces 73 are arranged at the spacing equal to the pitch of the spiral of the conveying member 4. However, the pitch of the elastic pieces 73 may be different from that of the spiral of the conveying member 4. In this case, the shape of the toner outlet is set according to the pitch of the elastic pieces 73 so that the toner can be supplied uniformly in its amount with respect to the widthwise direction of the developing device 34.

Figure 8:
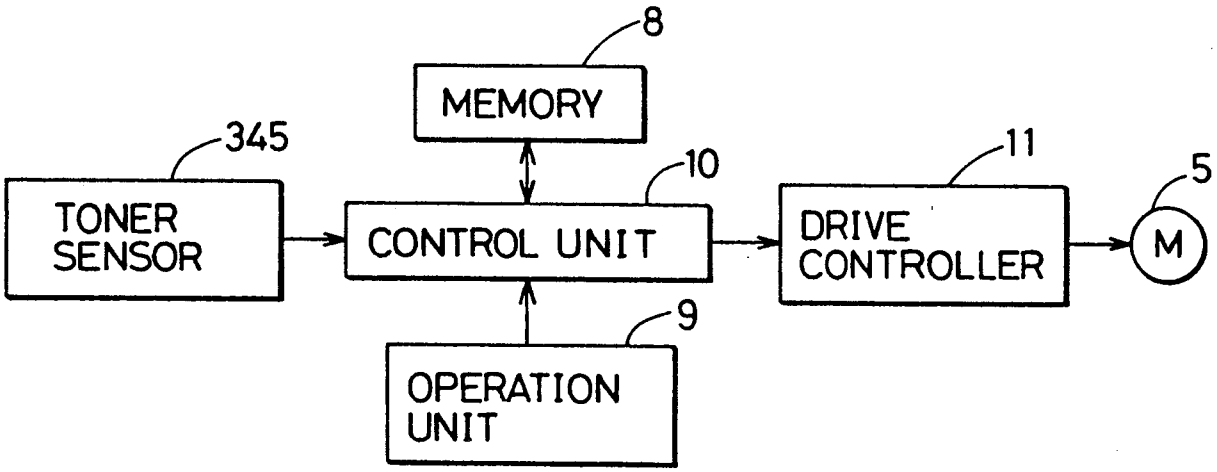
FIG. 8 is a block diagram showing an exemplary control system of the toner supply device.

There will be next described a construction of a control system for controlling the conveyance of toner in the toner supply device 1 with reference to FIG. 8.

This control system includes a memory 8, an operation unit 9, a control unit 10, and a drive controller 11. The memory 8 stores a conveyance time required to convey the toner in the toner conveyance path 3 from the toner cartridge mount portion 2 to a preset initial position in the vicinity of the toner outlet 7, a processing program of the control unit 10, etc. The conveyance time is calculated based on a distance between the mount portion 2 and the initial position, and a conveying speed, i.e. a rotating speed, of the conveying member 4.

The operation unit 9 includes an initialization switch (not shown) and other operation switches. The initialization switch is manipulated to designate execution of an initialization mode in which the drive motor 5 is driven for the conveyance time when the toner cartridge 6 is mounted on an unused toner supply device 1.

The control unit 10 includes a CPU and a timer, and sends a control signal to the drive controller 11 so as to execute the initialization mode when the initialization switch is turned on. Further, the control unit 10 discriminates whether the toner density detected by the toner sensor 345 is below a proper level. When the toner density is below the proper level, the control unit 10 sends the control signal to the drive controller 11 so as to drive the drive motor 5. Upon receipt of the control signal from the control unit 10, the drive controller 11 drives the drive motor 5.

Figure 9:
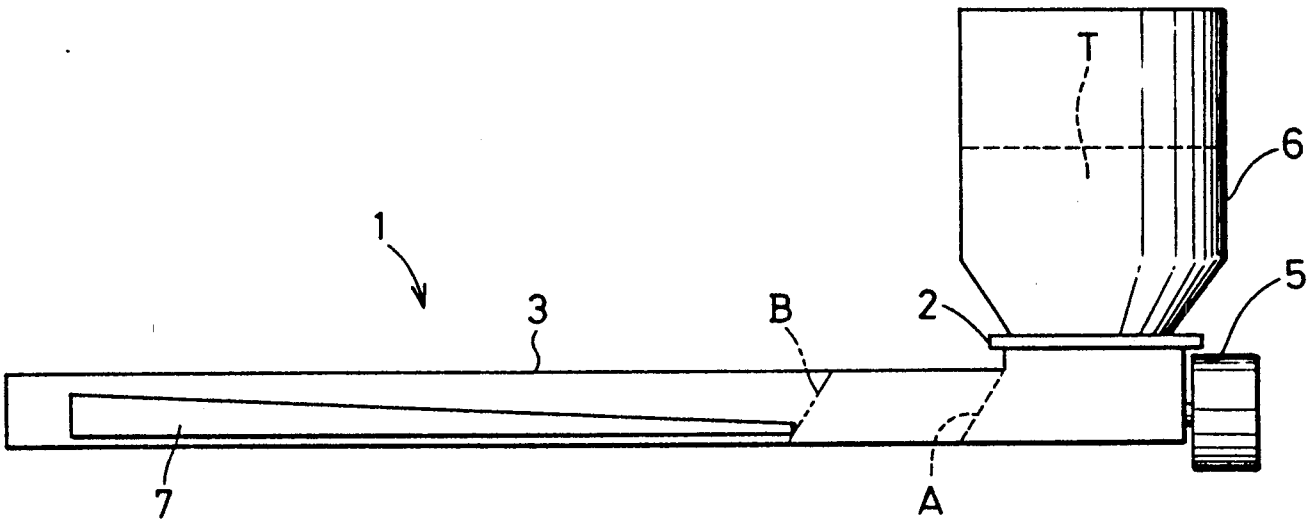
FIG. 9 is a schematic diagram showing a position of the toner in the toner supply device.
Figure 10:
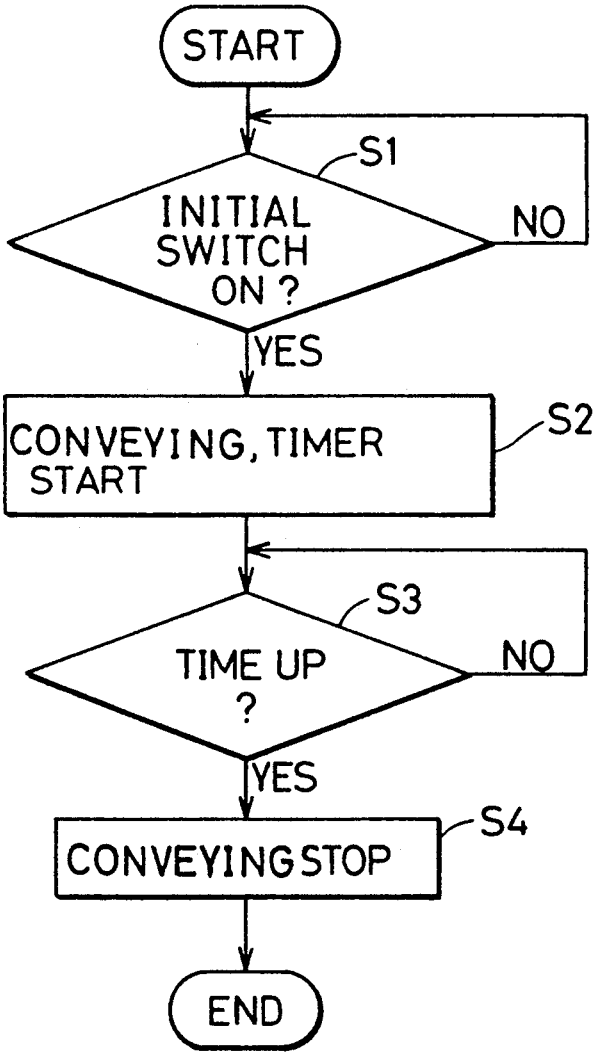
FIG. 10 is a flow chart showing an operation executed in an initialization mode of the toner supply device.

There will be described an operation executed in the initialization mode of the toner supply device 1 next with reference to FIGS. 9 and 10. In FIG. 9, the toner conveyance path 3 is represented as a straight path so as to show the position of the toner in the path 3 more easily.

First of all, it is discriminated whether the initialization switch is in the ON state in Step S1. This routine waits in Step S1 until the initialization switch is turned on (NO in Step S1). When an operator mounts the toner cartridge 6 on the toner supply device 1 and turns on the initialization switch (YES in Step S1), the control unit 10 determines that the initialization mode is designated, and accordingly sends the control signal to the drive controller 11. Thereupon, the drive motor 5 is driven, and the toner T is conveyed from the toner cartridge mount portion 2 (a position indicated by a dotted line A in FIG. 9). At the same time, the control unit 10 starts the timer so as to measure the conveyance time in Step S2.

Thereafter, the control unit 10 discriminates whether the timer has measured the conveyance time in Step S3. This routine waits in Step S3 until the timer measures the conveyance time (NO in Step S3). When the timer measures the conveyance time (YES in Step S3), the driving of the motor 5 is stopped, and thereby the conveyance of the toner T is stopped in Step S4. By this time, toner T has been conveyed up to the initial position (a position indicated by a phantom line B in FIG. 9).

If the toner density in the developing device 34 decreases below the proper level due to a copying operation carried out thereafter, the control unit 10 causes the drive motor 5 to be driven. This time, the conveyance of the toner T is started from the initial position. Thus, the toner T falls into the housing 341 through the toner outlet 7 immediately after the start of conveyance, with the result that the toner T can be supplied to the developing device 34 within a short time.

In this way, the toner T is conveyed from the position of the mount portion 2 to the initial position in the vicinity of the toner outlet 7 when the toner cartridge 6 is mounted on the unused toner supply device 1 and the initialization switch is turned on. Accordingly, the toner can be thereafter supplied to the developing device 34 immediately after it is detected that the toner density has decreased below the proper level. This prevents a further decrease in the toner density due to a delay in supplying the toner, thereby contributing to formation of satisfactory images.

In the above description, the control unit 10 discriminates that the toner T has been conveyed from the mount portion 2 to the toner outlet 7 by measuring the conveyance time with the use of the timer. However, the control unit 10 may make such a discrimination, for example, by detecting a rotating speed of the drive motor 5.

Further, the initialization mode is executed not only in the case where the toner cartridge 6 is mounted on the unused toner supply device 1, but also in the case where the toner is removed from the toner conveyance path 3 when the toner supply device 1 is repaired.

In the above description, the toner outlet 7 is formed in the toner conveyance path 3 in such a manner as to extend in the toner conveyance direction. However, the shape of the toner outlet 7 is not limited to this, but may be any shape provided that it is defined on the surface of the path 3 facing the developing device 34.

The foregoing embodiment is described with respect to a developing device 34 using the two-component developer including toner and carriers. However, the invention is also applicable to a developing device using one-component developer including only toner.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. A toner supply device attachable to a developing device, comprising:

mount means on which a toner cartridge is replaceably mountable and the toner is accumulated;

outlet means in communication with the developing device for discharging the toner to the developing device;

conveyance path means provided between the mount means and outlet means for connecting the mount means with the outlet means;

conveying means for conveying the toner from the mount means to the outlet means, said conveying means including a conveying member provided in the conveyance path means and drive motor means for driving the conveying member;

discriminator means for providing an indication that a fresh toner cartridge is mounted on the mount means;

memory means for storing a conveyance time of the toner from the mount means to an initial position located at an upstream vicinity position of the outlet means in accordance with a toner conveying speed of the conveying member; and control means connected to the discriminator means and the memory means, and responsive to the discriminator means, for controlling driving of the conveying member for the conveyance time, to convey the toner from the mount means to the initial position when said indication is provided that a fresh toner cartridge is mounted on the mount means.

2. A toner supply device as defined in claim 1 wherein the conveying member is in the form of a spiral.

3. A toner supply device as defined in claim 1 wherein the outlet means includes an oblong opening of a specified length which is defined longitudinally in the conveyance path means at a downstream side thereof.

4. A toner supply device as defined in claim 3 wherein the oblong opening is formed such that the width thereof increases gradually as it extends more toward a downstream side with respect to a toner conveying direction.

* * * * *